US005751315A

United States Patent [19]

Burke et al.

[11] Patent Number: 5,751,315

[45] Date of Patent: May 12, 1998

[54] THERMAL INK-JET PRINTHEAD WITH A THERMALLY ISOLATED HEATING ELEMENT IN EACH EJECTOR

[75] Inventors: Cathie J. Burke; R. Enrique Viturro, both of Rochester; John R. Andrews, Fairport; Narayan V. Deshpande, Penfield; Sean D. O'Brien, Victor, all of N.Y.

[73] Assignee: Xerox Corporation, Stamford, Conn.

[21] Appl. No.: 632,983

[22] Filed: Apr. 16, 1996

[51] Int. Cl.[6] ..... B41J 2/05

[52] U.S. Cl. ..... 347/63; 347/62

[58] Field of Search ..... 347/18, 67, 63, 347/203, 65

[56] References Cited

U.S. PATENT DOCUMENTS

| | | | |
|---|---|---|---|
| 4,532,530 | 7/1985 | Hawkins | 347/62 |
| 4,719,477 | 1/1988 | Hess | 347/59 |
| 4,894,664 | 1/1990 | Pan | 347/18 X |
| 5,017,941 | 5/1991 | Drake | 347/18 X |
| 5,506,608 | 4/1996 | Marler | 347/18 |

FOREIGN PATENT DOCUMENTS

| | | | |
|---|---|---|---|
| 60-478 | 1/1985 | Japan | B41J 3/20 |
| 61-283572 | 12/1986 | Japan | B41J 3/21 |
| 61-283573 | 12/1986 | Japan | B41J 3/21 |
| 62-94347 | 4/1987 | Japan | B41J 3/04 |

*Primary Examiner*—Joseph W. Hartary
*Attorney, Agent, or Firm*—R. Hutter

[57] ABSTRACT

An ejector for a thermal ink-jet printhead includes a heating element defined on a main surface of a silicon heater chip. A cavity is disposed within the heater chip opposite the side of the heating element exposed to liquid ink. In one embodiment, the heating element is disposed on a narrow pillar which is surrounded by two elongated trenches. In another embodiment, the heating element is suspended over a cavity by narrow supports. In each case, the cavity reduces the thermal mass of the structure supporting the heating element and acts as an insulator to prevent excess heat from being dissipated into the body of the heater chip.

8 Claims, 3 Drawing Sheets

FIG. 2
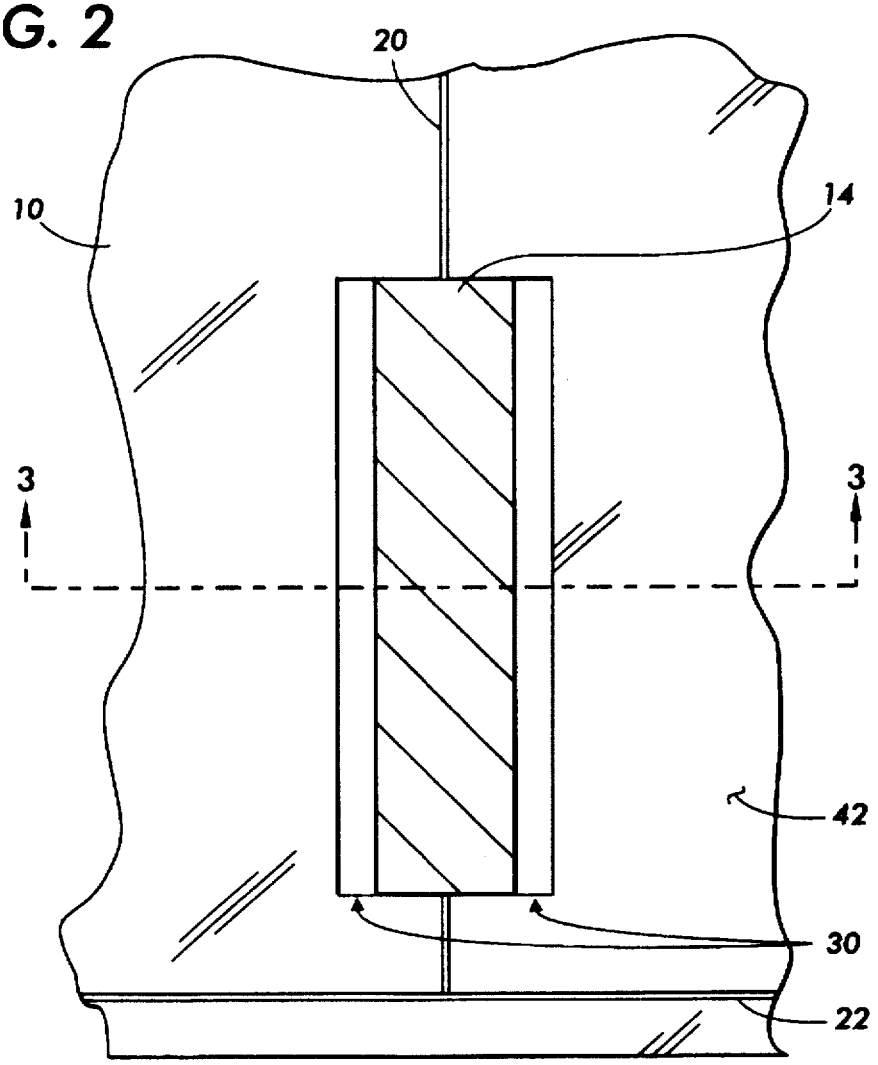
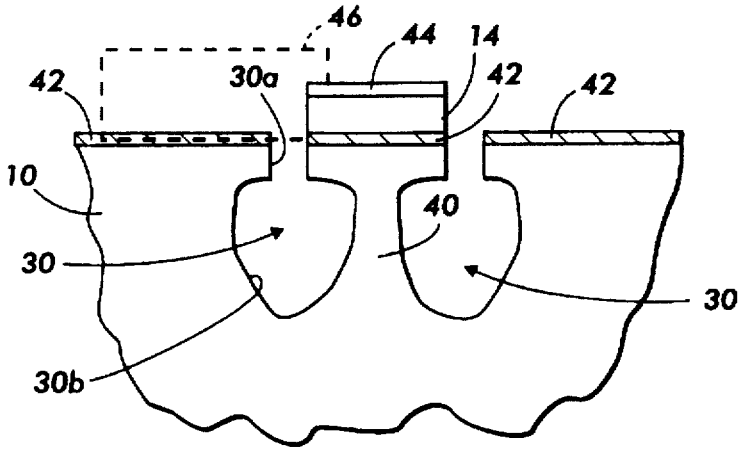
FIG. 3

FIG. 4
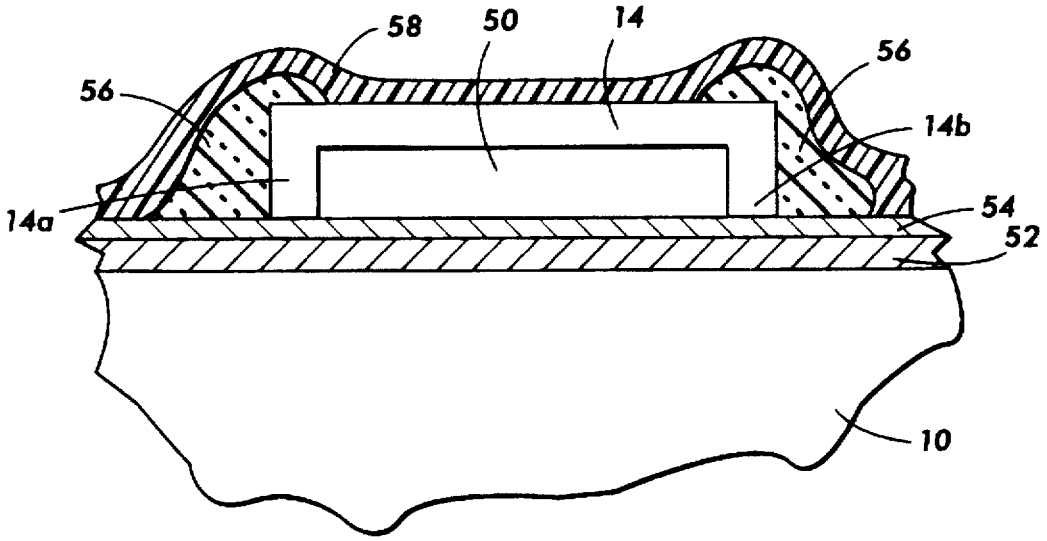
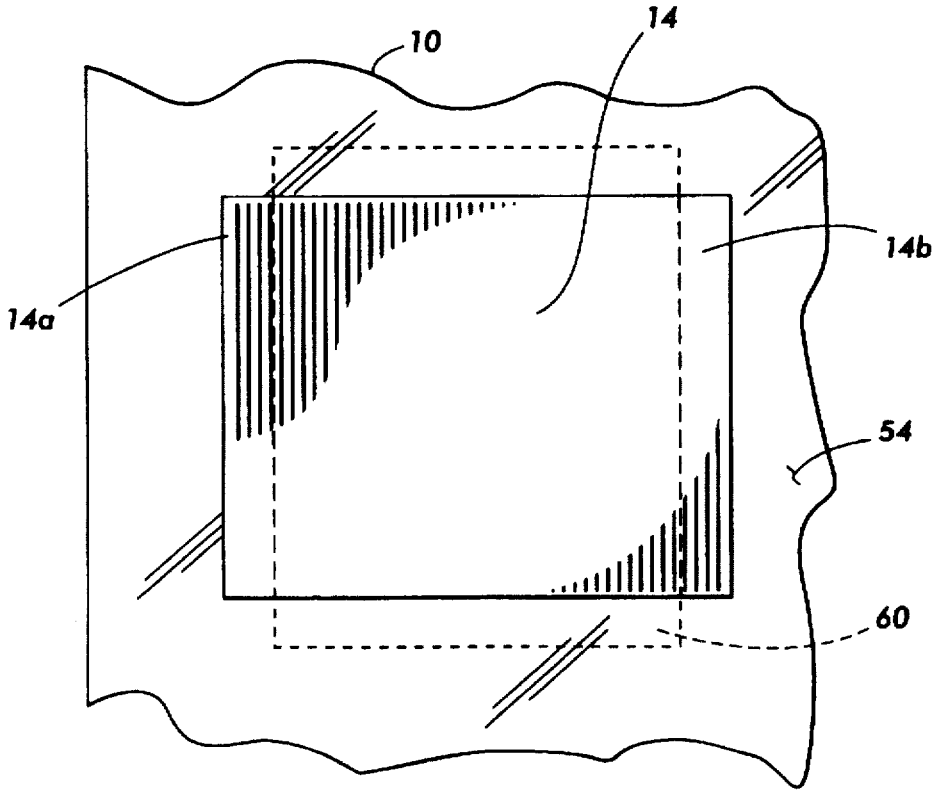
FIG. 5

THERMAL INK-JET PRINTHEAD WITH A THERMALLY ISOLATED HEATING ELEMENT IN EACH EJECTOR

The present invention relates to a printhead for a thermal ink-jet printer, in which the heating element of each ejector is suspended over an enclosed cavity, for purposes of thermal insulation.

In thermal ink-jet printing, droplets of ink are selectably ejected from a plurality of drop ejectors in a printhead. The ejectors are operated in accordance with digital instructions to create a desired image on a print sheet moving past the printhead. The printhead may move back and forth relative to the sheet in a typewriter fashion, or the linear array may be of a size extending across the entire width of a sheet, to place the image on a sheet in a single pass.

The ejectors typically comprise capillary channels, or other ink passageways, which are connected to one or more common ink supply manifolds. Ink is retained within each channel until, in response to an appropriate digital signal, the ink in the channel is rapidly heated by a heating element disposed on a surface within the channel. This rapid vaporization of the ink adjacent the channel creates a bubble which causes a quantity of liquid ink to be ejected through an opening associated with the channel to the print sheet. The process of rapid vaporization creating a bubble is generally known as "nucleation." One patent showing the general configuration of a typical ink-jet printhead is U.S. Pat. No. 4,774,530, assigned to the assignee in the present application.

In currently-common ink-jet printhead designs, such as the design shown in the above-referenced patent, the heating element is formed as a resistor in the surface of a silicon chip. While this arrangement of the heating element on a main surface of a chip is convenient from the standpoint of making the printhead, it has been found that disposing the heating element on a surface presents practical difficulties when the printhead is subject to demanding use, such as when printing at high speed or over long print runs. In brief, heat dissipated by the heating elements in a printhead is only partially functional to cause the ejection of liquid ink out of the printhead. Approximately half of all the heat generated by the heating elements in a printhead is not dissipated to the liquid ink directly, but rather is absorbed into the semiconductor chip, causing a general heating of the chip. This represents a simple waste of energy, which is particularly crucial in very large printheads, such as used in full-page-width designs; also, the constant heating of the printhead may seriously shorten the life span of the printhead.

Further, the gradual warming of the printhead over a long print run will undesirably pre-heat the liquid ink entering the printhead. As is well known, the precise size of ink droplets emitted from a printhead is closely related to the initial temperature of the liquid ink. If the liquid ink is consistently warmer than anticipated before it is ejected from the printhead, the resulting ink droplets will be larger than anticipated, creating larger ink spots on the print sheet, with a conspicuous negative effect on print quality. Various systems are known in the art for monitoring and compensating for the initial temperature of liquid ink, but it would be preferable simply to have a system in which heat is less likely to accumulate over a long period of use of the printhead.

According to one embodiment of the present invention, there is provided a thermal ink-jet printhead comprising at least one ejector. The ejector comprises a structure defining a capillary channel for passage of liquid ink therethrough, and a heater chip defining a main surface. A heating element is disposed on a portion of the main surface, with the heating element being exposed within the capillary channel. A cavity is defined in the heater chip, the cavity extending from a portion of the main surface adjacent the heating element to a portion of the heater chip disposed underneath the portion of the main surface of the heater chip including the heating element.

According to another embodiment of the present invention, there is provided a thermal ink-jet printhead comprising at least one ejector. The ejector comprises a structure defining a capillary channel for passage of liquid ink therethrough, and a heater chip defining a main surface. A heating element is disposed on a portion of the main surface, with the heating element being exposed within the capillary channel. A cavity is defined between a portion of the heating element and an area of the main surface of the heater chip.

Further according to the present invention, there is provided a method of creating a heating element for an ejector of a thermal ink-jet printhead. A substrate having a main surface is provided. A sacrificial layer is disposed on an area of the main surface, the sacrifical layer comprising an etchable material. A polysilicon layer is disposed over the sacrificial layer wherein a first portion of the polysilicon layer contacts the main surface of the substrate and a second portion of the polysilicon layer overlays the sacrificial layer. The sacrificial layer is removed, leaving a cavity between the second portion of the polysilicon layer and the main surface of the substrate.

In the drawings:

FIG. 2 is a plan view of a single ejector structure according to one embodiment of the present invention;

FIG. 3 is a sectional elevational view through lines 3—3 in FIG. 2 of the single ejector in FIG. 2;

FIG. 4 is a sectional elevational view through a single heating element in an ejector, according to another embodiment of the present invention; and FIG. 5 is a plan view of a heating element for an ejector as shown in FIG. 4, at an intermediate step in the fabrication thereof, according to a preferred technique of the present invention.

FIG. 1 is a highly simplified perspective view showing the portions of an ejector for a thermal ink-jet printhead incorporating the present invention.

Figure 1:
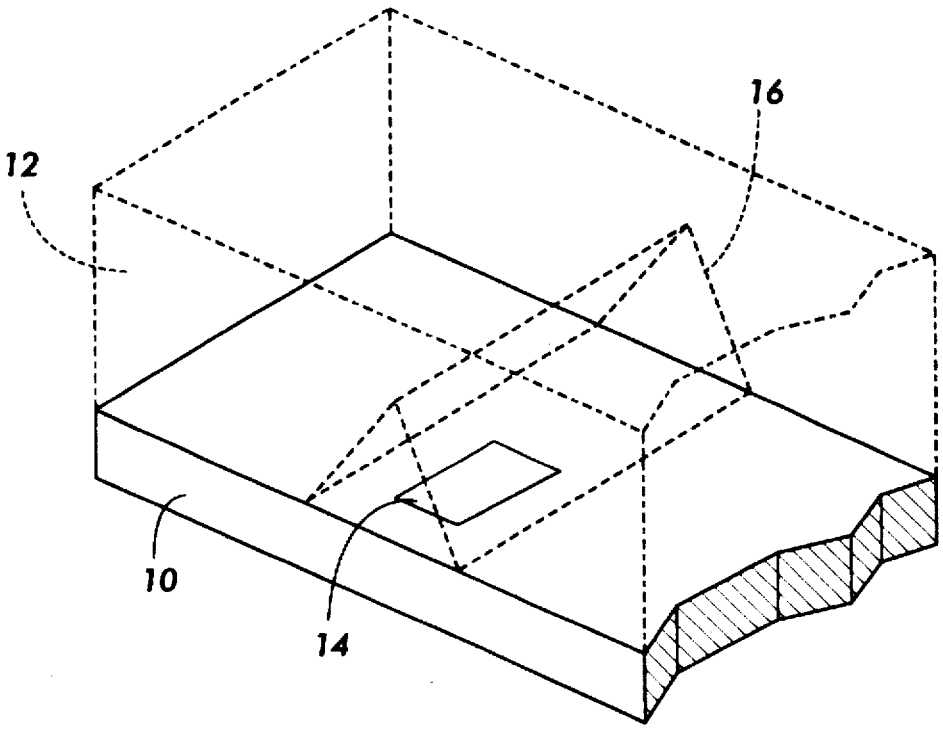
FIG. 1 PRIOR ART
FIG. 1 is a simplified perspective view showing the basic elements of a heater chip and channel chip in a single ejector of a thermal ink-jet printhead suitable for use in the present invention.

Although only one ejector is shown, it will be understood that a practical thermal ink-jet printhead will include 100 or more such ejectors, typically spaced at 300 to 600 ejectors per inch. Illustrated in FIG. 1 is the general configuration of what is known as a "side-shooter" printhead wherein the channels forming the ejectors are created between two chips which are bound together. The printhead comprises a heater chip 10, which is bound on a main surface thereof to a "channel chip" indicated in phantom as 12. The heater chip 10 is generally a semiconductor chip design as known in the art, and defines therein any number of heating elements, such as indicated as 14, on a main surface thereof. There is typically provided one heating element 14 for every ejector in the printhead. Adjacent each ejector 14 on the main surface of heater chip 10 is a channel 16 which is formed by a groove in channel chip 12. Channel chip 12 can be made of any number of ceramic, plastic, or metal materials known in the art. When the chip 10 is abutted against the channel chip 12, each channel 16 forms a complete channel with the adjacent surface of the heater chip 10, and one heating element 14 disposes a heating surface on the inside of the channel so formed, as shown in FIG. 1.

FIG. 1 shows a highly simplified version of a practical thermal ink-jet printhead, and any number of ink supply manifolds, intermediate layers, pit layers, etc., would be provided in a practical printhead. However, what is illustrated in FIG. 1 are the essential elements necessary to practice the present invention, and the addition of further elements to make a fully practical printhead will not detract from the claimed invention as described in detail below.

In operation, an ink supply manifold (not shown) provides liquid ink which fills the capillary channel 16 until it is time to eject ink from the channel 16 onto a print sheet. In order to eject a droplet of ink from channel 16, a small voltage is applied to heating element 14 in heater chip 10. As is familiar in the art of ink-jet printheads, heating element 14 is typically a portion of a semiconductor chip which is doped to a predetermined resistivity. Because heating element 14 is essentially a resistor, heating element 14 dissipates power in the form of heat through its heating surface (the heating surface being defined as the surface of heating element 14 disposed within channel 16), thereby vaporizing liquid ink immediately adjacent the heating surface. This vaporization creates a bubble of ink vapor within the channel, and the expansion of this bubble in turn causes liquid ink to be expelled out of the channel 16 and onto a print sheet to form a spot in a desired image being printed. As shown in the view of FIG. 1, it is intended that the ink supply manifold be disposed behind the printhead, so that the ejected ink droplet will be ejected out of the page according to the perspective of FIG. 1.

In order to reduce the amount of heat from a heating element which is "leaked" into the structure of the printhead itself, the present invention proposes printhead designs which exploit either or both of the following principles: either the thermal mass of the structure of the printhead directly under the heating element is reduced, or a thermally-insulating structure is provided under the heating element. In the first case, providing less thermal mass of the printhead directly under the heating element, one embodiment of the present invention proposes disposing the heating element 14 of each ejector on its own "pillar" on the heater chip, so that the heating element will in large part be isolated from the bulk of the heater chip, and excess heat from the heating element will not be readily absorbed into the bulk of the heater chip. With regard to the second case, another embodiment of the present invention proposes creating a cavity directly underneath the heating element 14, this cavity providing a substantial degree of thermal insulation between the heating element and the bulk of the chip. It will be understood that either design, according to different embodiments, will provide differing extents of reduced thermal mass and insulation, but the overall effect of either design is to restrict the dissipation of excess heat from the heating element to the bulk of the heater chip and printhead.

(As used in the specification and claims herein, the word "underneath" shall be construed not necessarily in the sense of being "closer to the ground," but rather in the sense of being on the side of the heating element opposite that of the capillary channel of the ejector.)

FIGS. 2 and 3 are a plan view and sectional elevational view of one particular embodiment of the present invention, in particular, with regard to the design of the heating element indicated as 14. Turning first to the plan view of FIG. 2, showing one individual heating element 14 of an ink-jet ejector in isolation, it can be seen that the heating element 14, which is an area of polysilicon which is doped to a specific resistivity to act as a heat-dissipating resistor, is disposed on a main surface of the heater chip 10, the bulk of which, as is typical in the art, comprises silicon. Heating element 14 has associated therewith a lead 20, of a conductive material such as aluminum, through which digital signals for activating the heating element 14 (such as to nucleate a bubble of liquid ink) can be applied. Each heating element 14 in a printhead is typically also connected to a common ground line indicated as 22 which completes the circuit for activating the heating element.

According to one embodiment of the present invention, there is disposed on either side along the length of heating element 14 (a typical length of heating element 14 being about 100–200 micrometers) two cavities, each of which is indicated as 30. These cavities 30 extend into the bulk of the heater chip 10, as shown clearly in the sectional elevational view of FIG. 3. Significantly, each cavity 30 includes a portion which extends underneath the portion of the main surface of the heater chip including the heating element 14; i.e., the heating element 14 is "undercut" to some extent by each cavity 30.

In FIG. 3 it can be seen that the heating element 14 is, in effect, disposed on a "pillar", indicated as 40, which is formed by the two cavities 30. With heating element 14 disposed on pillar 40, there is less thermal mass of the substance of chip 10 immediately adjacent the heating element 14, so that excess heat from heating element 14 (which will radiate "downward" in the view of FIG. 3) will have less structure available through which to conduct. In this way, the amount of excess heat being dissipated into the bulk of chip 10, which creates long-term performance problems, is reduced.

It will be noted in FIG. 3 that each cavity 30 has a general "inverted mushroom" shape. That is, for a top portion of each cavity 30, indicated in FIG. 3 as **30*a*, the cavity forms a relatively narrow trench for some distance into chip 10, but beyond a certain point each cavity expands, such as shown as portion 30*b*, in a manner which undercuts the area of the main surface of the chip directly underneath heating element 14. The purpose of this undercut is to minimize, within constraints of structural integrity, the size of the pillar 40, so that the amount of thermal mass supporting heating element 14** is minimized.

The two separate sections **30*a* and 30*b* of each cavity 30 can be obtained through a combination of individually-familiar techniques for etching cavities in a silicon structure such as the bulk of chip 10. In general, in order to obtain the narrow trench such as 30*a*, use of anisotropic reactive ion etching, such as with $Cl_2$, is used. Once the initial trenches 30*a* are obtained to the desired depth, the undercuts 30*b* can be obtained by continuing the etching process with isotropic etching such as by using a combination of $SF_6$ and $O_2$. Details of the process by which structures such as cavities 30*a* and 30*b*** can be recreated in silicon can be found in, for example, Zhang and McDonald, "A RIE Process for Submicron Silicon Electromechanical Structures," *Journal of Micromechanical Microengineering*, vol. 2, p. 31 (1992).

Other details of the structure of each individual etching are apparent in FIG. 3. According to one technique of manufacture, there is provided on the main surface of chip 10, before the etching of cavities 30, a layer of $SiO_2$ such as indicated as 42, which can be used as an etch-stop layer to control the etching area of cavities 30. The etch stop layer 42 would not be apparent in areas of the chip where the trenches **30*a* of cavities 30 are desired to be placed adjacent the area for each heating element 14**.

Each heating element 14 is formed in a polysilicon layer which is disposed on the $SiO_2$ layer 42, as mentioned above. This polysilicon layer forming each heating element 14 is doped to a desired resistivity. Further, according to a preferred embodiment of the present invention, there is disposed a passivation layer 44, which serves to protect the polysilicon from the corrosive effects of liquid ink. This passivation layer typically comprises a layer of tantalum which is electrically insulative from the polysilicon of heating element 14 with silicon nitride.

Further according to the preferred embodiment, a layer of polyimide can be provided around each heating element 14. A layer of thick polyimide (not shown) can be used to fill the cavities 30; as polyimide has desirable insulating properties, this layer can add a degree of thermal insulation and mechanical support in addition to the thermal mass reduction provided by the pillar 40. Further, additional layers of polyimide, such as indicated in phantom as 46, can be used to create desirable pit structures around the top surface of heating element 14 (that is, around passivation layer 44). As described in the '730 patent referenced above, creating a pit over each heating element 14 is known to improve nucleation of liquid ink.

FIG. 4 is a sectional elevational view of a heating element 14 according to another embodiment of the present invention. In this embodiment, there is disposed under the polysilicon forming heating element 14, a cavity 50 which is just slightly smaller in one dimension than the polysilicon 14 so that the bulk of polysilicon 14 is separated from the main surface of heater chip 10. According to a preferred embodiment of the present invention, if the dimensions of a heating element 14 horizontally as shown in FIG. 4 is from 50–200 micrometers, the size of the supports, indicated as **14*a* and 14*b* in FIG. 4 and which form part of the structure of heating element 14, are about 5 micrometers in width, so that almost all of heating element 14 is suspended over the main surface of chip 10. The cavity 50 may be filled with air or left as a vacuum; in either case, there is a substantial degree of thermal insulation between heat dissipated from heating element 14 and the bulk of chip 10**.

Also shown in FIG. 4 are other structures which contribute to the practicality of the heating element 14 in this embodiment. Once again, the bulk of heater chip 10 is silicon, which is provided with an overlayer 52 of $SiO_2$, and which may further include a binding layer 54, of silicon nitride. Also shown along the sides of heating element 14 are insulating portions 56, which are made of phosphosilicate glass; these insulating portions are used in combination with electrical leads (not shown) through which the heating element is activated. Finally, over the entire structure is disposed a passivation layer 58, which, as in the previously-described embodiment, typically comprises tantalum which is bound to the surface of heating element 14 by silicon nitride. This passivation layer protects the polysilicon of heating element 14 from the corrosive influence of various liquid inks. The overall purpose of these additional layers is to enclose the cavity 50 with respect to the capillary channel 16; i.e., it is intended that no liquid ink everenter the cavity 50.

In addition to the various layers shown in FIG. 4, there may further be provided any number of further layers such as to planarize the top surface of the chip 10, and and/or to create the desired "pit" around the perimeter of heating element 14. Also, it may be desirable to fill cavity 50 with an insulative material such as polyimide, as opposed to leaving it as a vacuum or merely filled with air.

It should be noted that, according to a preferred embodiment of the present invention, heating element 14 as shown in FIG. 4 is shown as only a heating element for nucleating liquid ink in a capillary channel of an ejector. There may exist in the prior art examples of piezoelectric pumps for use in certain types of ink jet ejectors wherein a diaphragm suspended over a cavity is used to physically pump liquid ink adjacent thereto. The present invention is not intended to function as a pump, but rather causes a nucleation of a bubble of liquid ink solely by heat dissipation.

According to a preferred technique according to the present invention, the cavity 50 underneath the heating element 14 may be created by use of a "sacrificial" layer which is placed on the main surface of chip 10 at one point in the fabrication of the heater chip 10, but which is removed before the creation of the finished chip. In brief, such a sacrificial layer can be created by depositing, through known techniques, a sacrificial layer of chemically-removable material such as phosphosilicate glass on those areas on the main surface of chip 10 corresponding to where the cavities 50 are intended to be in the final product. Subsequent layers, particularly the layer of polysilicon forming each heating element 14, are then placed over the sacrificial layers and then, when the sacrificial layers are removed, the desired cavity remains.

FIG. 5 is a plan view of a heating element 14 on a main surface such as nitride surface 54 of a chip 10, showing the relationship of heating element 14 to a deposited sacrificial layer indicated in phantom as 60. It will be noted that, comparing the outlines of the deposit of sacrificial layer 60 and heating element 14, that heating element 14 extends a greater length than sacrificial layer in one dimension, while in the other dimension sacrificial layer 60 is greater in length. As the polysilicon layer forming heating element 14 extends a greater length than sacrificial layer 60 in the horizontal dimension as shown in FIG. 5, it will be evident that the portions of heating element 14 which extend beyond the borders of sacrificial layer 60 will be disposed not over the sacrificial layer 60, but rather directly over the main surface of chip 10. These areas at the ends of heating element 14 thus form the supports **14*a*, 14*b* which can be seen in FIG. 4. Simultaneously, the fact that sacrificial layer 60 extends a greater length than heating element 14 in the other dimension allows a certain portion of sacrificial layer 60 to be exposed and not be covered by heating element 14**.

In order to remove the sacrificial layer to leave the desired cavity 50 under heating element 14, a chemical etchant is applied to the chip 10 directly after the stage in the manufacturing process right after the stage shown in FIG. 5. Once the sacrificial layer 60 is removed, all that will remain is the desired suspended structure of heating element 14. After this point, further layers, such as those shown in FIG. 4 and more can be applied to the chip 10.

It will be noted in FIG. 4 that insulative layers 56 are themselves made of phosphosilicate glass, and therefore would be liable to etching in the same step in which the sacrificial layer 60 is removed. One skilled in the art would recognize that the basic steps of creating the cavity 50 will have to be adapted so as not to interfere with the presence of other etchable structures on the chip, particularly circuitry.

Finally, with reference to FIG. 4, in a typical embodiment of the present invention, a typical thickness of cavity 50, from the top of layer 54 to the bottom of heating element 14, is approximately 0.5 micrometers. The main thickness of the suspended portion of heating element 14 is about 0.4 micrometers and the passivation layer 58 is typically the thickness of 0.5–0.6 micrometers.

While the invention has been described with reference to the structure disclosed, it is not confined to the details set forth, but is intended to cover such modifications or changes as may come within the scope of the following claims.

We claim:

1. A thermal ink-jet printhead comprising at least one ejector, the ejector comprising:

a structure defining a capillary channel for passage of liquid ink therethrough;

a heater chip defining a main surface and including a heating element disposed on a portion of the main surface thereof, the heating element being exposed within the capillary channel;

a first cavity defined in the heater chip, the cavity extending from a portion of the main surface adjacent the heating element to a portion of the heater chip disposed underneath a portion of the main surface of the heater chip including the heating element;

a second cavity defined in the heater chip, the second cavity extending from a second portion of the main surface adjacent the heating element to a second portion of the heater chip underneath a portion of the main surface of the heater chip including the heating element;

the heater chip defining a pillar disposed between the first cavity and the second cavity, the heating element being disposed on the pillar.

2. The printhead of claim 1, further comprising an insulative filler disposed in said first and second cavities.

3. The printhead of claim 2, the insulative filler comprising polyimide.

4. A thermal ink-jet printhead comprising at least one ejector, the ejector comprising:

a structure defining a capillary channel for passage of liquid ink therethrough;

a heater chip defining a substantially planar main surface and a heating element disposed on a portion of the main surface thereof, a surface of the heating element being exposed within the capillary channel;

the heating element comprising polysilicon and including at least one polysilicon support for contacting the substantially planar main surface of the heater chip; and a cavity defined between a portion of the heating element and an area of the main surface of the heater chip.

5. The printhead of claim 4, the heating element comprising polysilicon, a surface of polysilicon in the heating element being directly exposed to the cavity.

6. The printhead of claim 4, the heating element including at least one support portion in direct contact with the main surface of the heater chip.

7. The printhead of claim 4, further comprising a binding layer including silicon nitride on the main surface of the heater chip.

8. The printhead of claim 4, further comprising a passivation layer disposed over the heating element in the capillary channel.

* * * * *